US005157811A

United States Patent [19]

Bodolay

[11] Patent Number: 5,157,811

[45] Date of Patent: Oct. 27, 1992

[54] RECLOSABLE STRIP FASTENER WITH SELF OPENER

[75] Inventor: William A. Bodolay, Lakeland, Fla.

[73] Assignee: Package Machinery Company Bodolay/Pratt Division

[21] Appl. No.: 625,212

[22] Filed: Dec. 10, 1990

Related U.S. Application Data

[62] Division of Ser. No. 521,099, May 9, 1990, Pat. No. 5,036,643.

[51] Int. Cl.[5] ..... B65D 77/10

[52] U.S. Cl. ..... 24/30.5 R; 24/587; 24/704.1

[58] Field of Search ..... 24/30.5 R, 576, 587, 24/399, 400, 704.1; 383/63, 65

[56] References Cited

U.S. PATENT DOCUMENTS

| | | | |
|---|---|---|---|
| 3,495,306 | 2/1970 | Eichberg | 24/576 |
| 3,780,781 | 12/1973 | Uramoto | 383/65 X |
| 4,246,288 | 1/1981 | Sanborn, Jr. | 24/587 X |
| 4,601,694 | 7/1986 | Ausnit | 24/90 HA X |
| 4,691,373 | 9/1987 | Ausnit | 24/576 X |
| 4,846,585 | 7/1989 | Boeckmann et al. | 383/63 X |
| 4,878,763 | 11/1989 | Ausnit | 24/576 X |

FOREIGN PATENT DOCUMENTS 1010738 11/1965 United Kingdom ..... 24/576

*Primary Examiner*—James R. Brittain
*Attorney, Agent, or Firm*—Pettis & McDonald

[57] ABSTRACT

An improved form, fill, seal and separate packaging machine for reclosable containers is accomplished by a plurality of stations disposed along a path of travel of a thermoplastic web including means to attach a pair of mated, resealable closure strips to the base web. The machine is intermittent in its operation, with movement of the web through the machine controlled so that the various steps of applying the closure strips, forming, filling, sealing and separating the reclosable containers are performed during periodic stops of the machine. The machine is further characterized by its use of two pairs of web belts to move the web through the machine. A first pair of web belts initially receive the folded web stock and partially form and completely fill the containers. The second pair of web belts overlap with the downstream end of the first pair of belts, but are disposed lower than the first belts. When the filled partially formed containers pass from the first pair of belts to the second pair of belts, the unsealed free ends are exposed for final sealing and severing.

4 Claims, 3 Drawing Sheets

RECLOSABLE STRIP FASTENER WITH SELF OPENER

This is a division of application Ser. No. 521,099, filed May 9, 1990 now U.S. Pat. No. 5,036,645.

BACKGROUND OF THE INVENTION

1. Field of the Invention

The present invention relates to an improved form, fill, seal and separate packaging machine of the type primarily intended for use in packaging material in reclosable containers. The packaging machine of this invention is uniquely characterized by its means for applying zipper material to the web and subsequently forming, filling and separating a plurality of easily openable and reclosable containers.

2. Description of the Prior Art

One of the most significant advancements in the field of flexible packaging in recent years has been the introduction of reclosable, zipper-type plastic bags. While such containers have been publicly available for a number of years for general household use, only recently have such packages been introduced at a retail level for the sale of prepackaged items such as, for example, food products.

As the desirability of such reclosable packages for retail sales has been recognized, so has the need for efficient equipment for automatically forming, filling and sealing such reclosable containers. Numerous such devices are available today, but virtually all such machines presently available share inherent deficiencies primarily related to handling the zipper-type lock strip in the manufacturing and filling process. The packaging industry clearly recognizes that such zipper-type reclosable locks must substantially impermeable, particularly when the containers are filled with food products, and unnecessary stressing of the reclosable seals must be avoided during the forming and filling process. Accordingly, many present devices for forming, filling, sealing and separating reclosable containers orient the container vertically with the zipper-lock along one vertical edge during the filling process. One example of such a device is disclosed in U.S. Pat. No. 4,745,731 to Talbott, et al. According to the disclosure of that patent, the reclosable container is formed by wrapping the plastic web around a generally vertical fill tube, mating the opposed parts of the zipper-type lock to form a tube, and then filling the receptacles from an open end. Nevertheless, substantial manipulation of the web is required, and great care must be taken to mate the corresponding closure parts to insure a properly formed and sealed container.

It has also been noted in the industry that it would be desirable to construct a machine for forming reclosable containers wherein the zipper-lock material is added to the container base web during the container-forming operation. U.S. Pat. No. 4,812,074 discloses an apparatus for accomplishing this result. However, the apparatus of that patent is limited by its disclosure of the use of zipper material wherein the mating halves are joined one to the other by a unitary zipper web. This requires great precision in applying the zipper, and further requires that the material be folded precisely once the zipper material has been applied to the base web so that the reclosable feature will function properly. Furthermore, opening such a container requires severing the relatively thick and strong zipper web that extends between its mating halves.

It is, therefore, clear that there remains a great need in the art for a form, fill, seal and separate packaging machine suitable for packaging material in reclosable containers wherein the web and particularly its reclosable zipper-type lock are easily bonded to each other and are relatively unaffected and not subjected to mechanical stress during the forming, filling, sealing and separating procedures. Furthermore, such a device should be capable of relatively simple adjustment to accommodate the manufacture of reclosable packages of various sizes and weight content. Finally, such a device should, preferably, include means for easily opening the finished, sealed container while maintaining the container's integrity until it is initially opened.

SUMMARY OF THE INVENTION

The present invention relates to an improved form, fill, seal and separate packaging machine of the type primarily intended for use in packaging material in reclosable containers. More specifically, the packaging machine of this invention is uniquely characterized by its means for applying a new zipper material to the container base web, folding the web having the zipper material attached thereto, and proceeding through the work stations of the packaging machine for forming, filling, sealing and separating the final reclosable containers. The zipper material comprises a pair of mated, resealable closure strips and means for attaching the zipper material to the base web are provided. The zipper material is further characterized by its construction to include a tear line formed along one of the closure strips, whereby the final containers may be easily opened while maintaining the integrity of each container until it is initially opened. No external tool or implement is required to open containers formed by the improved machine of this invention.

It is also to be noted that the present invention is an improvement of the invention described and claimed in my co-pending application Ser. No. 07/436,911, filed Nov. 14, 1989, the disclosure of which is specifically incorporated herein by reference.

As the plastic web utilized to form the containers is provided from the web supply means, a zipper supply means provides zipper material onto the base web. The zipper material comprises a pair of mated, releasable closure strips, and the strips are joined as supplied from the zipper supply means. The web and zipper material next encounter means for attaching the zipper material to the web. In the preferred embodiment, the means for attaching comprises a first means for bonding one of the closure strips to the web. The web and the partially-attached zipper material are then folded, and this folded web enters subsequent work stations of the packaging machine.

Once folded, the web is engaged by second means for bonding the other of the closure strips to the base web. At that time, the second means for bonding further comprises means for forming a pull tab. It is this pull tab which is used to open the finished container to provide access to the zipper.

The pair of closure strips comprising the zipper material are unique in that each closure strip comprises a strip base having a width defined by top and bottom edges. The width defined between the top and bottom edges of the one closure strip is greater than the width of the other closure strip. Formed along the top edge of the other, narrower closure strip is a tear line, and the tear line is substantially adjacent that top edge. Accordingly, as is set forth in greater detail below, once the container has been formed, filled and separated, a user has merely to pull the pull tab to rupture the top, folded segment of the container, thereby providing easy access to the zipper material for use of the container in its intended fashion.

While the preferred embodiment of this invention, described in detail below, illustrates a machine suitable for forming, filling and separating single containers, it is to be understood and appreciated that the machine of this invention could be easily modified to permit simultaneous forming and filling of two or more containers through the working sections of the machine. Within the industry, such a machine is normally referred to as a "two-up" machine.

Once the zipper material has been applied to the base web and the base web and zipper material have been folded onto each other and final attachment of the zipper material to the web, along with formation of the pull tab, that folded web enters the subsequent work stations of the packaging machine. A control drive means is provided to regulate the intermittent travel of the web through the packaging machine so that the various forming, filling, sealing and separating steps are performed simultaneously as the flow of the web through the machine is periodically stopped.

The folded web is initially received by first web belt means which direct the folded web to the means for bonding the other of the closure strips to the web. The web next proceeds to a hole punch and seal station where an aperture is formed through the container above the closure strips, and not within the volume where container contents will be placed. This aperture may be used for hanging completed packages on a display rack, for example. The web next moves to a station for spot sealing the zipper material at intervals corresponding to the final container width. At this same station, the pull tab used to open the completed container is also formed. Means for forming a side seal normal to the closure strips are provided downstream of the means for spot sealing. As the side seal is made, means are provided for partially severing the side seals to define partially formed containers which are open at their free edges held between the first web belt means.

The partially formed containers then advance to the means for filling wherein a pair of opposed bag opening means grip the free edges of the folded web and pull them outwardly to define an open mouth for filling the container. Described in greater detail in my co-pending application with regard to a preferred embodiment for the packaging machine of this invention are the details of the means for filling whereby the control drive means is actually reversed to provide sufficient "slack" in the web and the first web belt means to permit their separation.

Downstream of the means for filling the first web belt means terminates, and the filled partially formed reclosable containers are transferred to a second web belt means. The path of travel defined by the second web belt means is parallel to the path of travel of the first web belt means, but the second web belt means is disposed slightly below the first web belt means. Thus, as the filled partially formed containers are transferred from the first web belt means to the second, the filled, but only partially formed, containers are held so as to expose their free edges. The containers then enter means for forming a top seal to close the containers completely, and, next, to means for cutting the closed containers from the web to provide individual reclosable packs.

It should also be noted that a load support conveyor is provided immediately beneath the means for filling and extending therefrom beyond the means for cutting and thereby separating the completed containers. The load support conveyor means is in abutting, supporting relation to the fold of the web, thereby reducing, if not virtually eliminating, mechanical stresses placed on the reclosable seal as each container is filled.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
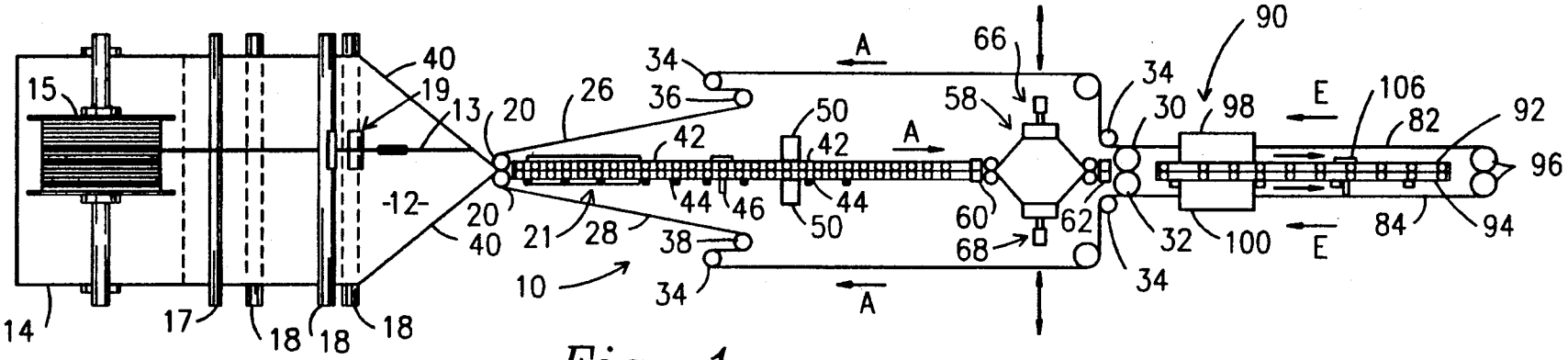
FIG. 1 is a top schematic view of the flow path of the web and zipper material passing through the various work stations of this packaging machine.
Figure 2:
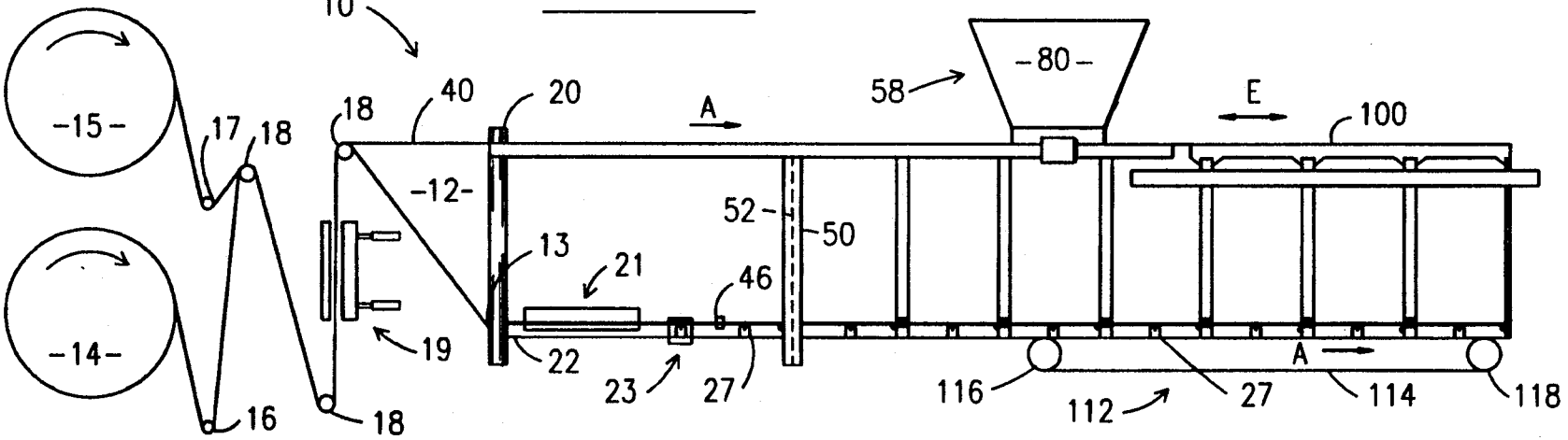
FIG. 2 is a side elevation view of the machine as shown in FIG. 1.

The views of FIGS. 1 and 2 illustrate the packaging machine of this invention, generally indicated as 10. Packaging machine 10 utilizes a web 12 of thermoplastic or thermoplastic-coated material for forming the containers. As shown in FIGS. 1 and 2, web supply means comprising a reel 14 and delivery rollers 16 and 18 as well as turning rollers 20 provide a supply of web 12 to the remainder of packaging machine 10.

A zipper supply means comprising a zipper reel 15 provides a supply of zipper material 13 onto a top surface of web 12 and to the remainder of packaging machine 10 around zipper delivery roller 17, delivery rollers 18 and turning rollers 20.

As perhaps best seen in the view of FIG. 1, the zipper material 13 is applied to the surface of web 12 substantially adjacent, but spaced apart from the web fold line, that fold line being designated by the reference numeral 22.

As the web 12 and zipper material 13 pass between the last pair of delivery rollers 18, they are operatively engaged by means for attaching the zipper material 13 to the web 12. In this preferred embodiment, the means for attaching comprises a first means for bonding, generally indicated as 19 in the views of FIGS. 1 and 2. First means for bonding 19 forms a thermal bond between the zipper material 13 and the web 12 to partially attach the zipper material 13 to the web 12. Then, the web 12 with the zipper material 13 at least partially attached thereto is folded onto itself as it passes through turning rollers 20 to the remainder of the packaging machine 10. Therefore, throughout the remainder of machine 10, web 12 carries with it the zipper material 13 substantially adjacent the fold 22 along the relative bottom of machine 10.

Mounted downstream of the web and zipper supply means, is the first web belt means comprising a pair of first endless belts 26 and 28. Endless belts 26 and 28 are driven in the direction shown by arrows A by control drive means comprising machine drive rollers 39 and 32. A plurality of guide rollers 34 are also provided for belts 26 and 28. Finally, a pair of festoon rollers 36 and 38 also define elements of the first web belt means and the festoon rollers 36 and 38 are movable back and forth in the direction parallel to the path of travel of web 12 through machine 10 whereby the partially formed container may be opened for filling, as explained in my co-pending application.

As perhaps best seen in the view of FIG. 1, web 12 is turned by rollers 20 such that free edges 40 are received and held between belts 26 and 28. Positive retention of free edges 40 between belts 26 and 28 is assured by the provision of first web holding means 42 fixedly mounted adjacent belt 26 opposite free edges 40 and a plurality of biased second web holding means 44 mounted in biased engagement adjacent belt 28. Because second web holding means 44 are biased toward belt 28, free edges 40 of folded web 12 are held firmly between belts 26 and 28 and travel therewith as indicated by arrows A.

Figure 3:
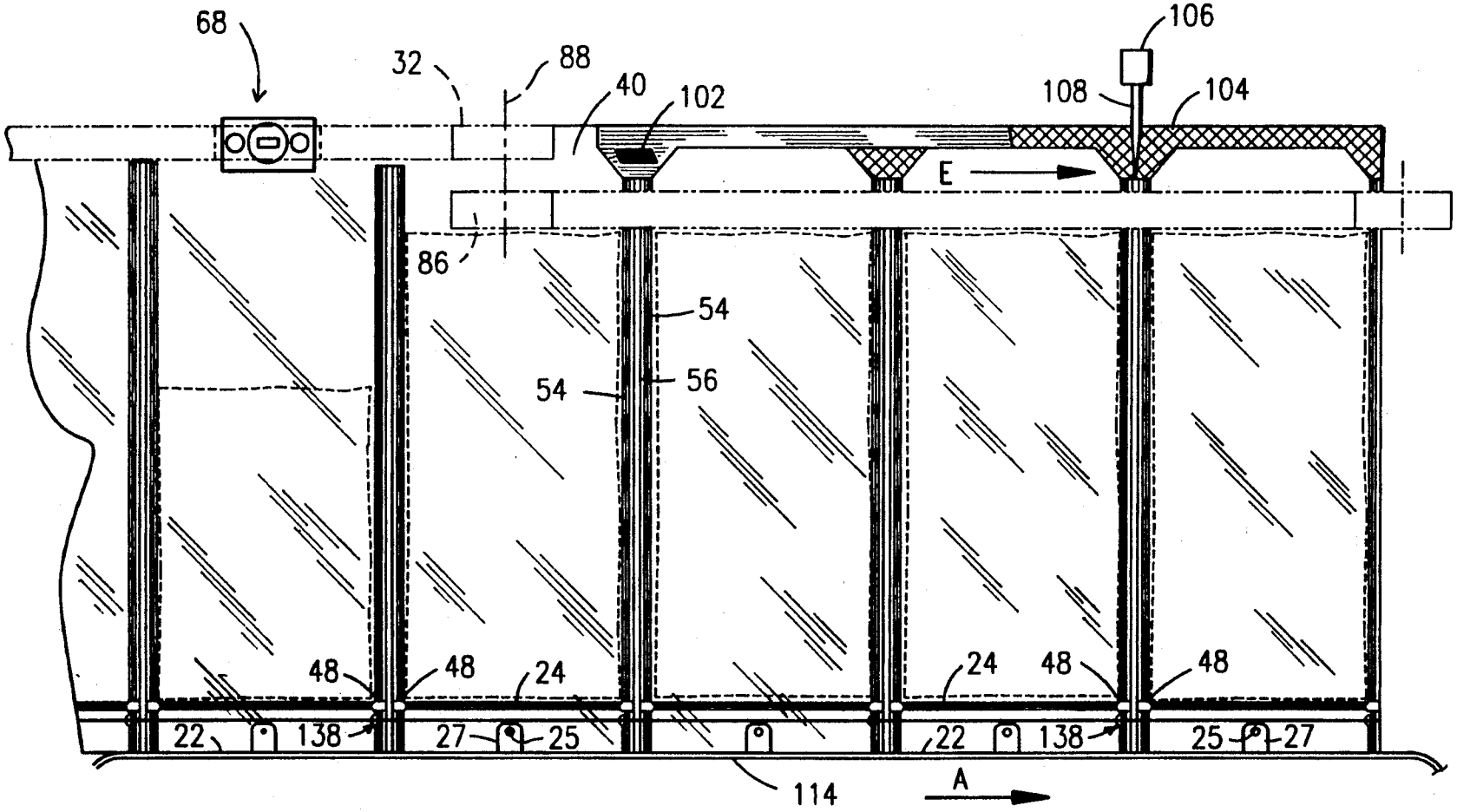
FIG. 3 is a fragmentary detail view showing the means for transferring the web from the first web belt means and the means for top sealing, the means for cutting, and a segment of the load support conveyor means therebelow.

As folded web 12 and partially-attached zipper material 13 pass into engagement with first belts 26 and 28 between first web holding means 42 and second web holding means 44, upon stopping drive rollers 30 and 32, web 12 and zipper material 13 are engaged by second means for bonding, generally indicated as 21. As described in greater detail below, the second means for bonding 21 thermally attaches the remainder of zipper material 13 to web 12. The folded web 12 having the zipper material 13 bonded thereto is next engaged by means for forming an aperture, generally indicated as 23, and the resulting aperture 25 and surrounding aperture seal 27 are best seen in the view of FIG. 3. Also with reference to the view of FIG. 3, it can be seen that aperture 25 and its surrounding aperture seal 27 are formed substantially adjacent fold 22 and in spaced apart relation to zipper-type lock 24. The aperture 25 extends through both the front and back portions of web 12 and through the strip base 124 of the one strip 120. Because aperture 25 extends through strip base 124 and is sealed as shown at 27, relatively strong means are provided for hanging the filled containers and seal 27 preserves the integrity of the container until it is opened by the ultimate user.

The apertured container is next engaged by spot sealer 46 which is actuated to seal zipper-type lock 24 as indicated at 48 in the view of FIG. 3. In order to facilitate opening the container, the spot sealer 46 further comprises means in the nature of a sealer cutter for forming a pull tab for tear line 136, the pull tab being generally indicated as 138 in the views of FIGS. 4 and 5. As the spot seal 48 is made, the means for forming a pull tab 138 simultaneously forms a seal 140 completely through the container and a pair of converging cuts 142 whereby tear line 36 may be pulled to open the top of the container above zipper lock 24, thereby permitting use of the container and its contents in a resealable fashion.

Next, the folded web 12 and spot sealed zipper lock 24 is engaged by means for forming container side seals, that means comprising side seal heater bars 50. As indicated in phantom in the view of FIG. 2, side seal heater bar 50 further includes severing means 52 for substantially bisecting the side seals 54 formed by side seal heater bars 50. Thus, the individual containers are partially severed one from another by cut line 56 as best seen in the view of FIG. 3.

The partially formed containers then enter the means for filling, which has been generally indicated as 58. Details concerning the construction and operation of the means for filling 58 are given in my co-pending application referenced above and incorporated herein. However, it can be see that filling means 58 comprises a first web clamp 60 mounted in engaging, restraining relation to first belts 26 and 28 and free ends 40 held therebetween downstream of side seal heater bars 50. The filling means 58 further comprises a second web clamp 62 also mounted in engaging, restraining relation to first belts 26 and 28 downstream of first web clamps 60.

Opening the partially severed container is accomplished by the action of first bag opening means and second bag opening means, generally indicated as 66 and 68, respectively. Material may be introduced into the container from feed hopper 80. Once filling has been completed, first and second clamp 60 and 62 open and the partially severed, filled containers held between belts 26 and 28 resume a path of travel as indicated by directional arrows A.

The filled partially severed containers are next transferred from the first web belt means to the second web belt means comprising second endless belts 82 and 84. As perhaps best seen in the view of FIG. 3, second belt 84 is normally driven in the direction indicated by Arrow E by second drive roller 86 which is mounted on the same shaft 88 as first drive roller 32. Though not shown in the drawings, a corresponding second drive roller controls the movement of second endless belt 82 and is similarly mounted immediately below first drive roller 30 Thus, it can be seen that the means for transferring the filled, partially severed containers from the first web belt means to the second web belt means basically comprises overlapping the belts downstream of the means for filling 58. In FIG. 3, it can clearly be seen that because second endless belts 82 and 84 are disposed below first belts 26 and 28, a segment of free edges 40 now extends above belts 82 and 84. This unique construction significantly facilitates final sealing and separating of the filled containers.

The filled, partially severed containers are next engaged by means for top sealing the containers generally indicated as 90 in the view of FIG. 1. However, it is also to be noted that, as with the first web belt means, the second web belt means comprises third web holding means 92 corresponding to first web holding means 42, and biased fourth web holding means 94, corresponding to biased second web holding means 44. Finally, guide rollers 96 are also provided for belts 82 and 84.

The means for top sealing 90 comprises any suitable device such as, for example, heater bars 98 and 100 for bonding the exposed free ends 40 to each other. As best seen in the view of FIG. 3, heater bar 100 includes an elongated portion which is somewhat longer than the width of the filled container, and an enlarged head 102. It should be noted that head 102 intersects the partially severed side seal 54 and, in combination with the elongated arm of heater bar 100 completely seals free edges 40 of the filled container. The completed top seal is indicated by cross hatching 104 in the view of FIG. 3.

The filled sealed containers are severed from web 12 by the action of cutting means 106. The cutting means 106 comprises a knife 108 having a relatively blunt tip. Upon actuation of cutting means 106, the blunt tip will enter cut line 56, and knife 108 will sever the filled, sealed containers from web 12.

In order to support the filled containers, both partially severed and totally severed, machine 10 further comprises a load support conveyor means generally indicated as 112 in the view of FIG. 2. Load support conveyor means 112 comprises an endless belt 114 having a direction of travel substantially parallel to that of the machine path of travel and is indicated by directional arrow A in the view of FIG. 3. Through means not shown, movement of endless belt 114 around its rollers 116 and 118 corresponds to the movement of drive rollers 30 and 32 and second drive roller 86. As is clearly apparent in the views of FIGS. 2 and 3, load support conveyor means 112 engages fold 22 of filled containers to relieve stress which might be placed on zipper-type lock 24 as well as on top edges 40.

Figure 4B:
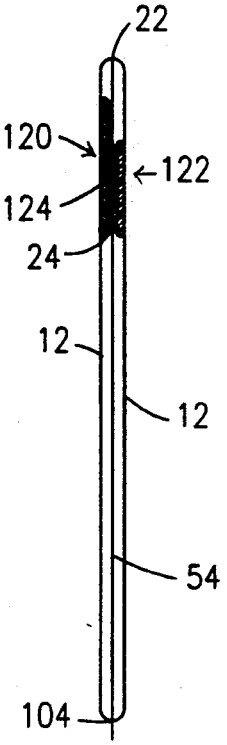
FIG. 4B is a sectional view taken along line B—B in FIG. 4.
Figure 4:
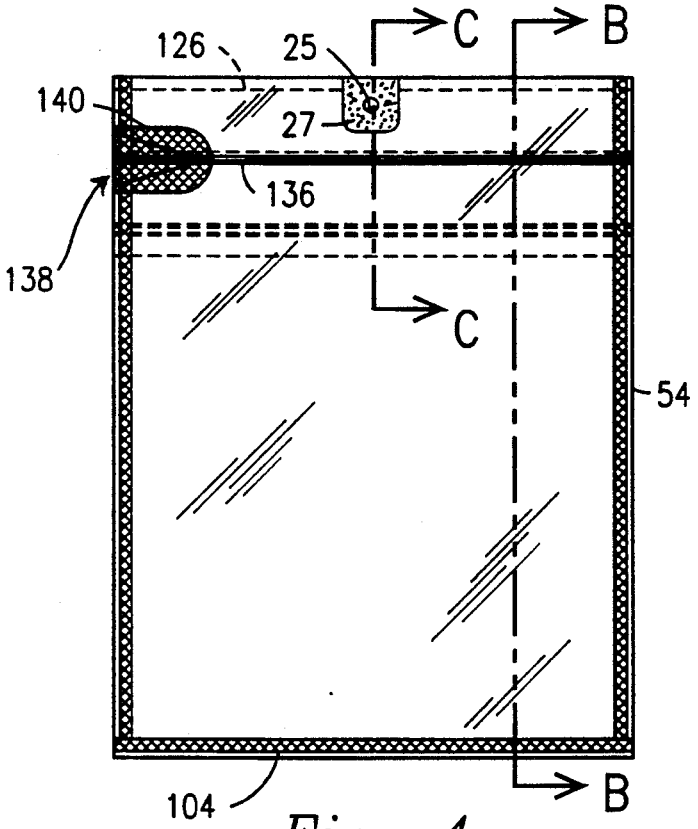
FIG. 4 is a plan view of a reclosable container formed by this packaging machine.
Figure 4C:
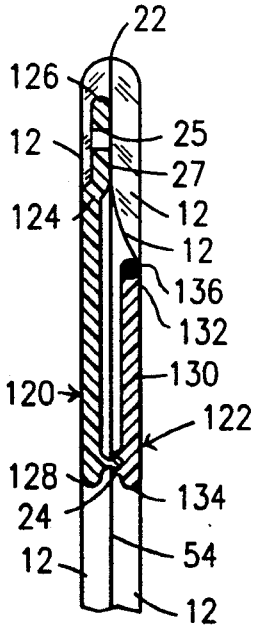
FIG. 4C is a sectional view taken along line C—C in FIG. 4 and is enlarged similar to the view of FIG. 6.
Figure 6:
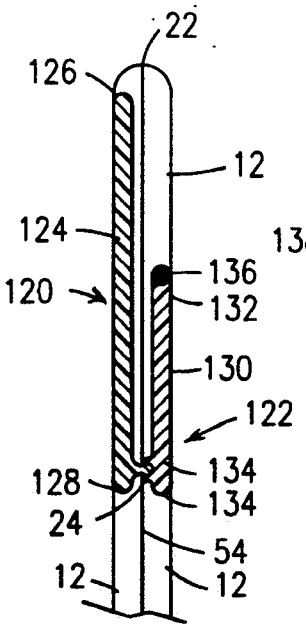
FIG. 6 is an enlarged view of the top portion of the container as shown in the sectional view of FIG. 4B.
Figure 5:
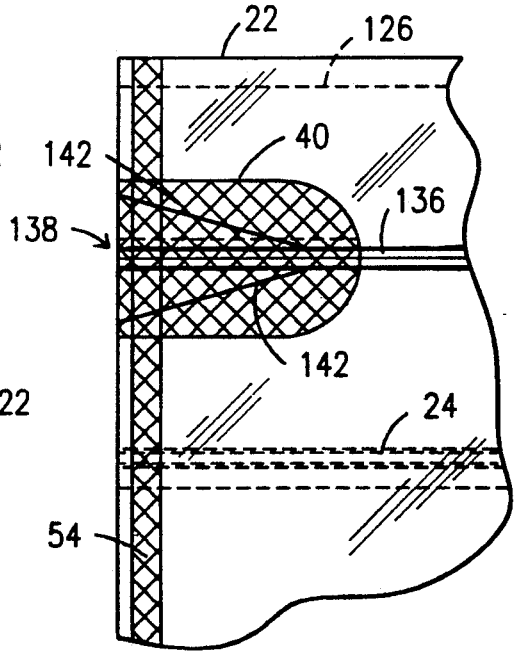
FIG. 5 is a detailed view of the pull tab and tear line of the container shown in FIG. 4.

Attention is now invited to the container as shown in the views of FIGS. 4–6. As best seen in the enlarged view of FIG. 6, the zipper material comprises a pair of mated, releasable closure strips. One of the closure strips has been designated generally as 120, and the other of the strips has been designated generally as 122. The one strip 120 includes a strip base 124 having a width defined by its corresponding top and bottom edges, 126 and 128, respectively. The second closure strip 122 is similarly constructed to include a strip base 130 having a width defined by its top and bottom edges 132 and 134, respectively. It can be seen that the width of the one strip 120 is greater than the width of the other strip 122. It is also to be noted that it is the one strip 120 which is bonded to the web 12 by the first means 19. The second closure strip 122 is bonded to web 12 by second means 21.

Of special note is the provision of a tear line 136 along top edge 132 of the other strip 122. Tear line 136 is integral with strip base 130 and is sufficiently strong to permit rupturing of the container by pulling tear line 136. This is accomplished by gripping and pulling the segment of pull tab 138 between cuts 142.

It is therefore clear that the machine 10 of this invention provides unique, efficient means for forming, filling, sealing and separating reclosable containers from virtually any web stock because of its provision of means for affixing a unique zipper lock material thereto. Furthermore, because of the construction of the two halves of the zipper material to include a tear line on one of those halves, the integrity of the filled container is in no way compromised. Also, as already pointed out above, initial opening of the container to gain access to the zipper-type lock may be easily accomplished without the necessity of utilizing any external appliance. According to procedures well known in the packaging arts, it can be appreciated that the machine of this invention could be adapted quite easily to operate within a closed, essentially sterile environment for the packaging of food products and medications. Also, as indicated above, the machine of this invention could be adapted to form, fill and separate more than one container at a time. Finally, reference is again made to my copending application fully identified above with regard to further operating details and structural alternatives.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A releasable zipper-type fastener primarily intended for use in forming reclosable containers, said fastener comprising: a pair of mating resealable closure strips, each one of said strips comprising a strip base having a width defined by top and bottom edges of each of said strip bases, the width of one of said closure strips being greater than the width of the other of said closure strips such that said top edge of said one closure strip extends beyond said top edge of said other closure strip when said closure strips are releasably mated to each other; and a tear line integrally formed on and defining said top edge of said other closure strip, whereby pulling said tear line will separate same from said tip edge.

2. A fastener as in claim 1 wherein said closure strips are releasably mated to each other adjacent said bottom edges.

3. A fastener as in claim 1 wherein said top edges of said closure strips are free from each other.

4. A fastener as in claim 1 wherein said tear line comprises a strengthened portion defining said top edge of said other closure strip.

* * * * *

UNITED STATES PATENT AND TRADEMARK OFFICE

CERTIFICATE OF CORRECTION

PATENT NO. : 5,157,811

DATED : October 27, 1992

INVENTOR(S) : William A. Bodolay

It is certified that error appears in the above-identified patent and that said Letters Patent is hereby corrected as shown below:

In the CLAIMS:

Claim 1, column 8, line 48, "tip" should be --top--.

Signed and Sealed this

Sixteenth Day of November, 1993

Bruce Lehman

*Attest:*

BRUCE LEHMAN

*Attesting Officer*

*Commissioner of Patents and Trademarks*